US006882705B2

(12) United States Patent
Egley et al.

(10) Patent No.: US 6,882,705 B2
(45) Date of Patent: Apr. 19, 2005

(54) TUNGSTEN COMPOSITE X-RAY TARGET ASSEMBLY FOR RADIATION THERAPY

(75) Inventors: Bert D. Egley, Walnut Creek, CA (US); Todd Howard Steinberg, Antioch, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 54 days.

(21) Appl. No.: 10/253,459

(22) Filed: Sep. 24, 2002

(65) Prior Publication Data

US 2004/0057555 A1 Mar. 25, 2004

(51) Int. Cl.[7] ..... H01J 35/12
(52) U.S. Cl. ..... 378/141; 378/143
(58) Field of Search ..... 378/127, 130, 378/141, 143, 144

(56) References Cited

U.S. PATENT DOCUMENTS

| | | | | |
|---|---|---|---|---|
| 4,149,310 A | | 4/1979 | Nippert | |
| 4,185,365 A | | 1/1980 | Hueschen et al. | |
| 4,224,273 A | | 9/1980 | Magendans et al. | 264/259 |
| 4,296,804 A | | 10/1981 | Press et al. | 165/133 |
| 4,331,902 A | | 5/1982 | Magendans et al. | 313/330 |
| 4,482,837 A | | 11/1984 | Koizumi et al. | 378/144 |
| 4,928,296 A | | 5/1990 | Kadambi | |
| 5,008,918 A | | 4/1991 | Lee et al. | 378/144 |
| 5,397,050 A | | 3/1995 | Mueller | 228/193 |
| 5,768,338 A | | 6/1998 | Kuroda et al. | 378/143 |
| 6,393,099 B1 | * | 5/2002 | Miller | 378/143 |
| 6,430,260 B1 | * | 8/2002 | Snyder | 378/130 |
| 6,580,780 B1 | * | 6/2003 | Miller | 378/141 |
| 2002/0085676 A1 | | 7/2002 | Snyder | |

FOREIGN PATENT DOCUMENTS

| | | |
|---|---|---|
| DE | 3124913 | 1/1983 |
| JP | 56086448 | 7/1981 |
| WO | WO 2002/039792 A3 | 5/2002 |

* cited by examiner

*Primary Examiner*—Craig E. Church
*Assistant Examiner*—Jurie Yun

(57) ABSTRACT

An x-ray target assembly including a housing having a recess, a cooling fluid contained within the recess and an x-ray target attached to the housing, wherein the x-ray target does not directly contact the cooling fluid.

20 Claims, 6 Drawing Sheets

Protocol 1:
SYMint = 0.5 %
Flatness = 2.4 %
OAR = 100.8 %
Max. dose = 100.8 %
Min. dose = 96.0 %
Dav = 98.4 %
-penumbra = 0.94 cm
+penumbra = 0.94 cm
Act. FS = 10.96 cm
Least Square (17)

Protocol 1:
SYMint = 0.7 %
Flatness = 2.5 %
OAR = 101.1 %
Max. dose = 101.1%
Min. dose = 96.1 %
Dav = 98.6 %
-penumbra = 0.93 cm
+penumbra = 0.93 cm
Act. FS = 10.99 cm
Least Square (17)

TUNGSTEN COMPOSITE X-RAY TARGET ASSEMBLY FOR RADIATION THERAPY

BACKGROUND OF THE INVENTION

1. Field of the Invention

The present invention relates to an x-ray target assembly. The x-ray target assembly preferably is used with a charged particle accelerator in a radiation therapy machine.

2. Discussion of Related Art

It is known to produce x-rays by bombarding an x-ray target assembly with electrons emitted from a charged particle accelerator. FIGS. 1 and 2 show an embodiment of a known x-ray target assembly used within radiation therapy machines manufactured and sold by Siemens Medical Solutions of Concord, Calif. under the trade names of Mevatron and Primus. The x-ray target assembly 100 includes a stainless steel cylindrical housing 102 that is supported by a pair of tubes 103.

Within the interior of the housing 102, a graphite cylindrical electron absorber 104 is centrally located within the housing 102 and is supported upon an annular bottom piece 106 of the housing 102. The annular bottom piece 106 is attached to bottom side edges of the housing 102 via mechanical fasteners, such as screws, inserted into openings 108 of the piece 106 and openings of the housing 102.

As shown in FIG. 2, an annular recess 110 is formed within the housing 102. On top of the recess 110 a stainless steel top cover 112 of the housing 102 is attached to the top edges of the housing 102 via a braze or a weld joint. The recess 110 is filled with a cooling fluid, such as water, that flows within tube 103*a* and enters into the recess 110. The water within the recess 110 is removed therefrom by flowing within tube 103*b* and exiting from the housing 102. Thus, the arms 103*a* and *b* allow for cool water to be continually supplied within the recess 110 and so the x-ray target assembly 100 is continually cooled by water.

A gold target 116 is inserted into the central opening 114 and attached to the edges of the opening 114 via a braze or weld joint. The water within the recess 110 cools the underside of the gold target 116 when the target 116 is being bombarded by electrons.

One disadvantage of the above described anode is that fatigue or stress cracks can be formed in the gold target 116 when bombarded by pulsed electron beams over a period of time. Such cracks can lead to water leaks in the x-ray target assembly 100 which renders the x-ray target assembly 100 inoperable. These water leaks can also cause considerable damage to other components in the radiation therapy machine.

Another disadvantage of the x-ray target assembly 100 described above is that there is a possibility that galvanic corrosion of the braze alloy will occur upon contact of the braze alloy with water. Such corrosion can result in water leaks forming in the x-ray target assembly 100. Such corrosion can be accelerated when the x-ray target assembly 100 is in an environment of ionizing radiation.

SUMMARY OF THE INVENTION

One aspect of the present invention regards an x-ray target assembly including a housing having a recess, a cooling fluid contained within the recess and an x-ray target attached to the housing, wherein the x-ray target does not directly contact the cooling fluid.

A second aspect of the present invention regards an x-ray target assembly including a housing having a recess, an x-ray target attached to the housing and a cooling fluid contained within the recess, wherein the cooling fluid is sealed within the recess via a joint not susceptible to galvanic corrosion.

A third aspect of the present invention regards a joint assembly that includes a first piece made of a first material and a second piece made of a second material that is different than the first material, where the first piece is separated from the second piece by a gap. A high quality electron beam weld joint is formed between the first piece and the second piece within the gap.

A fourth aspect of the present invention regards a method of forming a high quality electron beam joint by positioning a first piece made of a first material from a second piece made of a second material that is different than the first material so that a gap is formed therebetween. Applying an electron beam to the gap so that a high quality weld joint is formed that is not susceptible to galvanic corrosion.

One or more aspects of the present invention provide the advantage of reducing stress related cracks in an x-ray target assembly.

One or more aspects of the present invention provide the advantage of reducing the risk of leakage of cooling fluid within the x-ray target assembly.

Further characteristics and advantages of the present invention ensue from the following description of exemplary embodiments by the drawings.

DETAILED DESCRIPTION OF THE PREFERRED EMBODIMENTS

Figure 3:
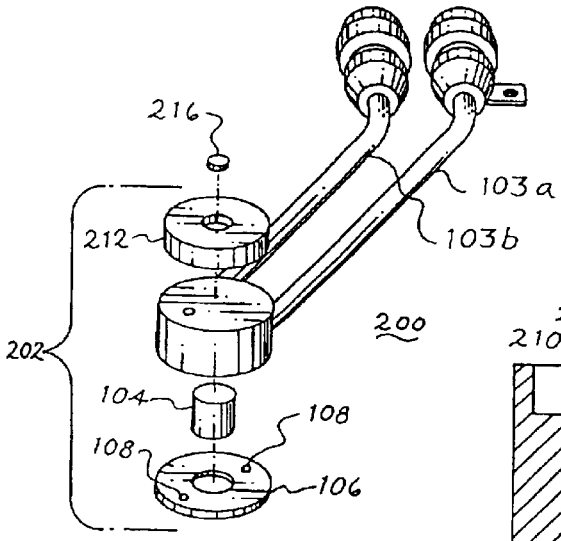
FIG. 3 shows an exploded view of an embodiment of an x-ray target assembly in accordance with the present invention.

An x-ray target assembly to be used for various applications, including medical radiation therapy, according to an embodiment of the present invention will be described with reference to FIGS. 3 and 4. The x-ray target assembly 200 is similar to the x-ray target assembly 100 in some aspects and so like numerals will denote like elements.

The x-ray target assembly 200 includes a stainless steel cylindrical housing 202 that is supported by a pair of tubes 103. Within the interior of the housing 202, a graphite cylindrical electron absorber 104 is centrally located within the housing 202 and is supported upon an annular bottom piece 106 of the housing 202. The annular bottom piece 106 is attached to the housing 202 via mechanical fasteners, such as screws, inserted into openings 108 of the piece 106 and openings of the housing 202.

Figure 4:
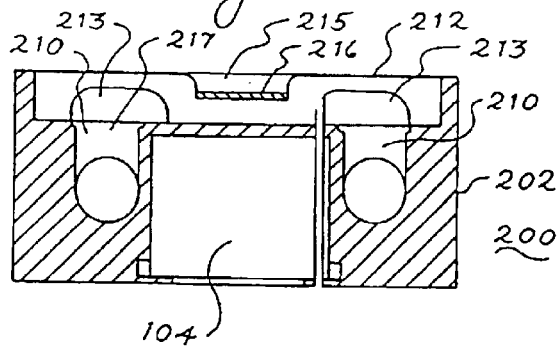
FIG. 4 shows a cross-sectional view of the x-ray target assembly of FIG. 3.

As shown in FIG. 4, an annular recess 210 is formed within the housing 202. On top of the recess 210 a copper heat sink top cover 212 of the housing 202 is attached to the top edges of the housing 202 via a process, such as electron beam welding, that forms a joint that is not susceptible to galvanic corrosion. The joint needs to be of a high quality meaning that the there is good penetration and no voids or cracks are formed. In the case of using an electron beam welding process to form a weld joint between the dissimilar metal parts of the housing 202 and the top cover 212, an electron beam welding machine is operated so as to direct an electron beam at a portion of the annular gap formed between the housing 202 and the top cover 212 when positioned as shown in FIG. 4. The housing 202 is placed on a rotating platform so that the entire annular gap is electron beam welded. In operation, the electron beam possesses electrons having an energy that can have a value ranging from approximately 110 keV to 140 keV. The electron beam has a current that has a value ranging from approximately 7 to 10 A and the beam has a diameter that is less than 1 mm. The size of the gap is less than 0.1 mm and the rate that the annular gap rotates has a value that ranges from 80 to 100 cm/min.

The copper top cover 212 is annular-like in shape having an outer diameter of approximately 30 mm. The top cover 212 has a maximum thickness of approximately 4 mm. As shown in FIG. 4, the top cover 212 has a bottom annular recess 213 that has an inner diameter of approximately 13 mm, an outer diameter of approximately 23 mm and a height of approximately 2 mm. The top cover further includes a central circular recess 215 having a diameter of approximately 6 mm and a depth of approximately 2 mm.

Once the top cover 212 is placed on top of the housing 202 a recess 217 is formed as the sum of the recesses 210 and 213. The combined recess 217 is filled with a cooling fluid, such as water, via tubes 103*a–b* in the same manner described previously that recess 110 is filled with water. A tungsten x-ray target in the form of cylindrical disk 216 is inserted into the central circular recess 215. The disk 216 has a diameter of approximately 6 mm and a thickness of approximately 1 mm. The disk 216 is attached to the edges and bottom of the recess 215 via a braze material. Since the water within the recess 217 does not directly contact the tungsten disk 216, the water indirectly cools the underside of the tungsten disk 216 via the top cover 212 when the disk 216 is being bombarded by electrons. The top cover 212 acts as a heat sink and as a barrier that prevents the brazing material from undergoing galvanic corrosion. Furthermore, any fatigue or stress cracks that occur in the tungsten disk 216, which is a rarity in itself, will not result in leakage of the water since the top cover 212 and the housing 202 encase the water.

Note that the tungsten material of disk 216 is mechanically superior to the gold material of disk 116 in that it has a four times higher fatigue strength and a three times higher melting temperature. The amount of tungsten material used is selected so as to produce the same output as the gold x-ray target 116 described previously.

Figure 5:
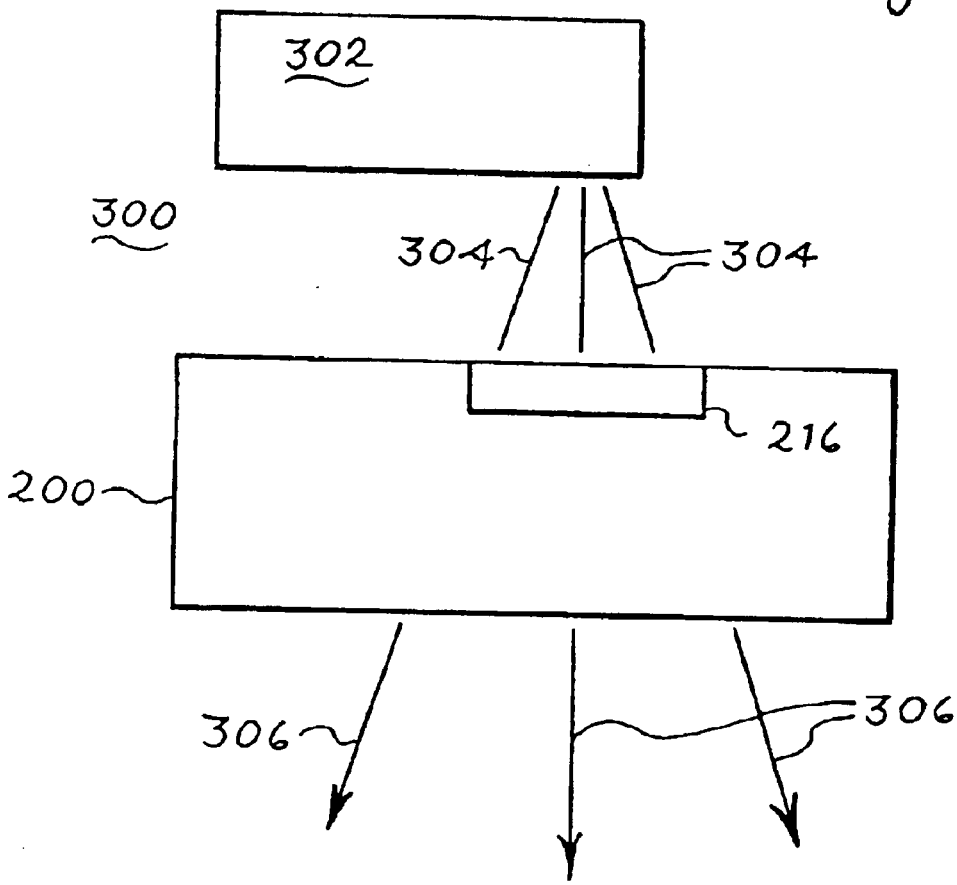
FIG. 5 schematically shows an embodiment of an x-ray generator that uses the x-ray target assembly of FIGS. 3–4 in accordance with the present invention.

As schematically shown in FIG. 5, an x-ray generator 300 in accordance with the present invention includes the x-ray target assembly 200 described previously and a particle source, such as a charged particle accelerator 302. The charged particle accelerator 302 accelerates electrons 304 so that they strike the tungsten x-ray target 216 that results in the generation of x-rays 306. The above described x-ray generator can be used within radiation therapy machines, for example.

Figure 1:
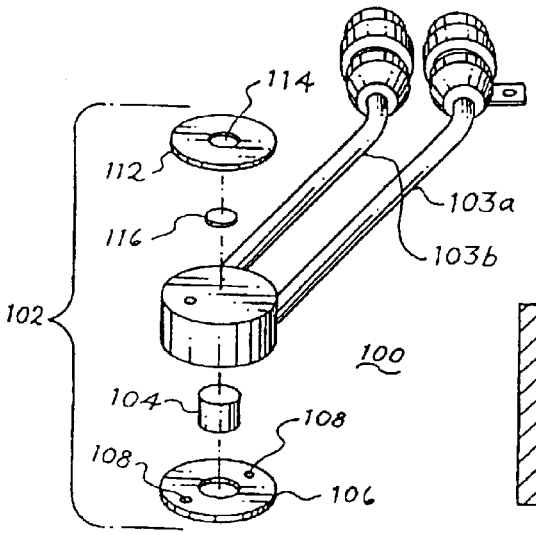
Fig. 1 (PRIOR ART)
FIG. 1 shows an exploded view of a known x-ray target assembly.
Figure 2:
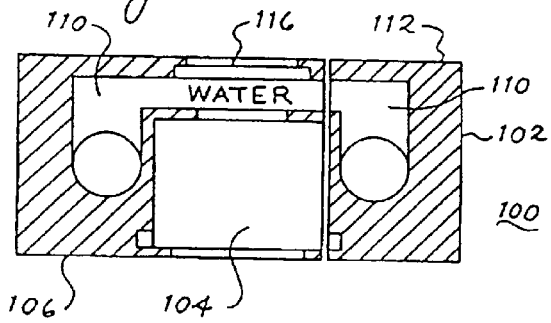
Fig. 2 (PRIOR ART)
FIG. 2 shows a cross-sectional view of the x-ray target assembly of FIG. 1.
Figure 6:
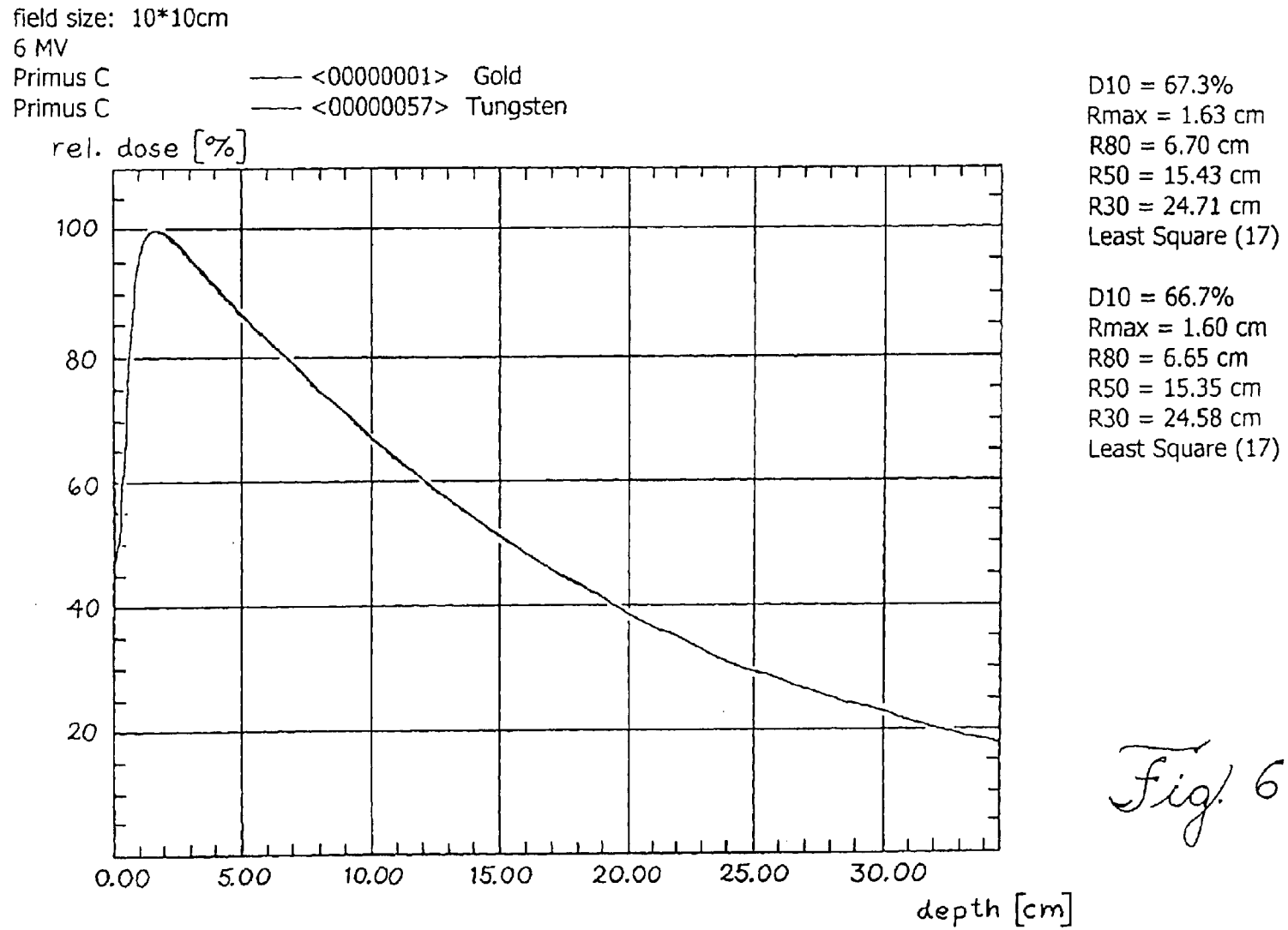
FIGS. 6–7 show various dose distribution charts for 6MV photons generated by the x-ray target assemblies of FIGS. 1–6.
Figure 7:
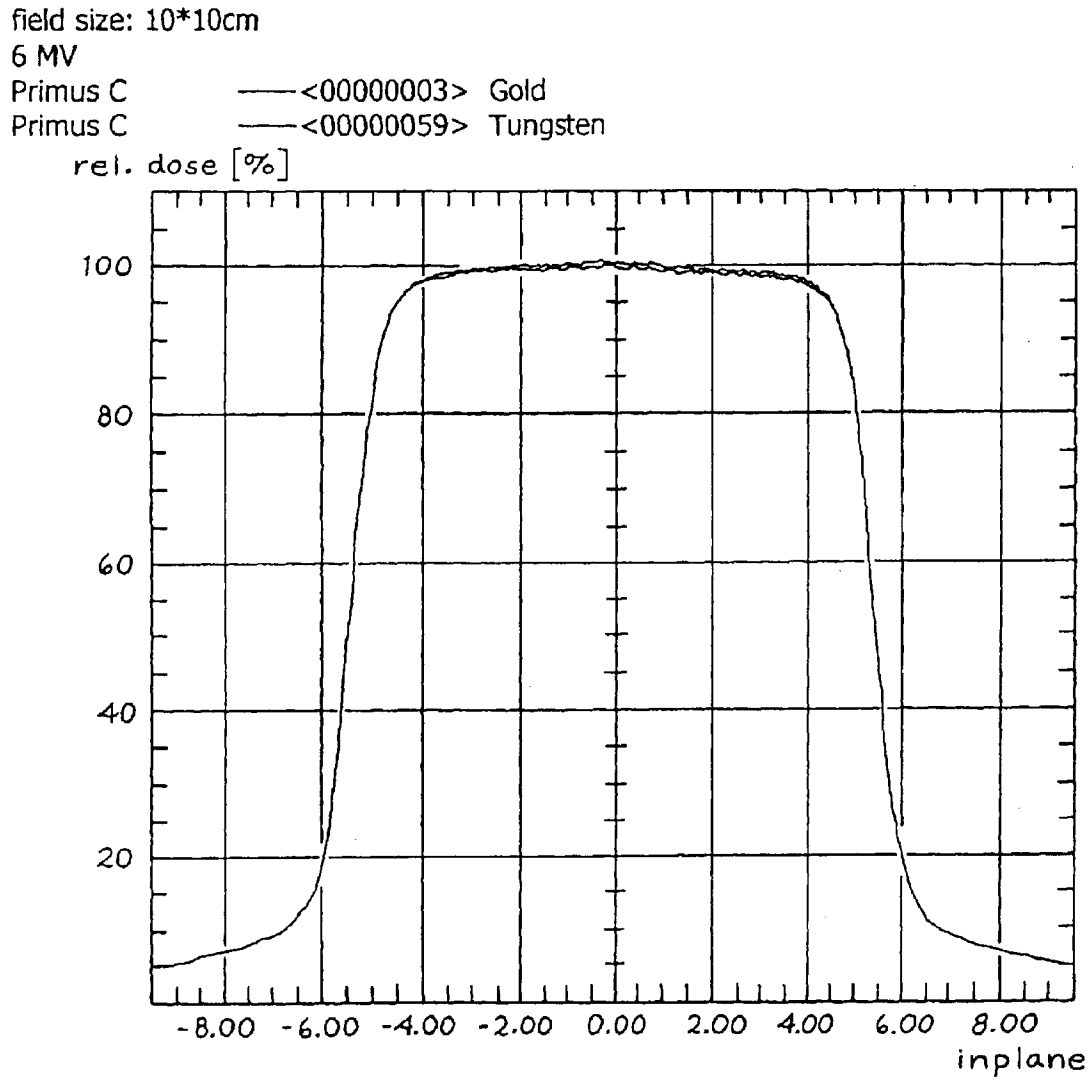
Figure 8:
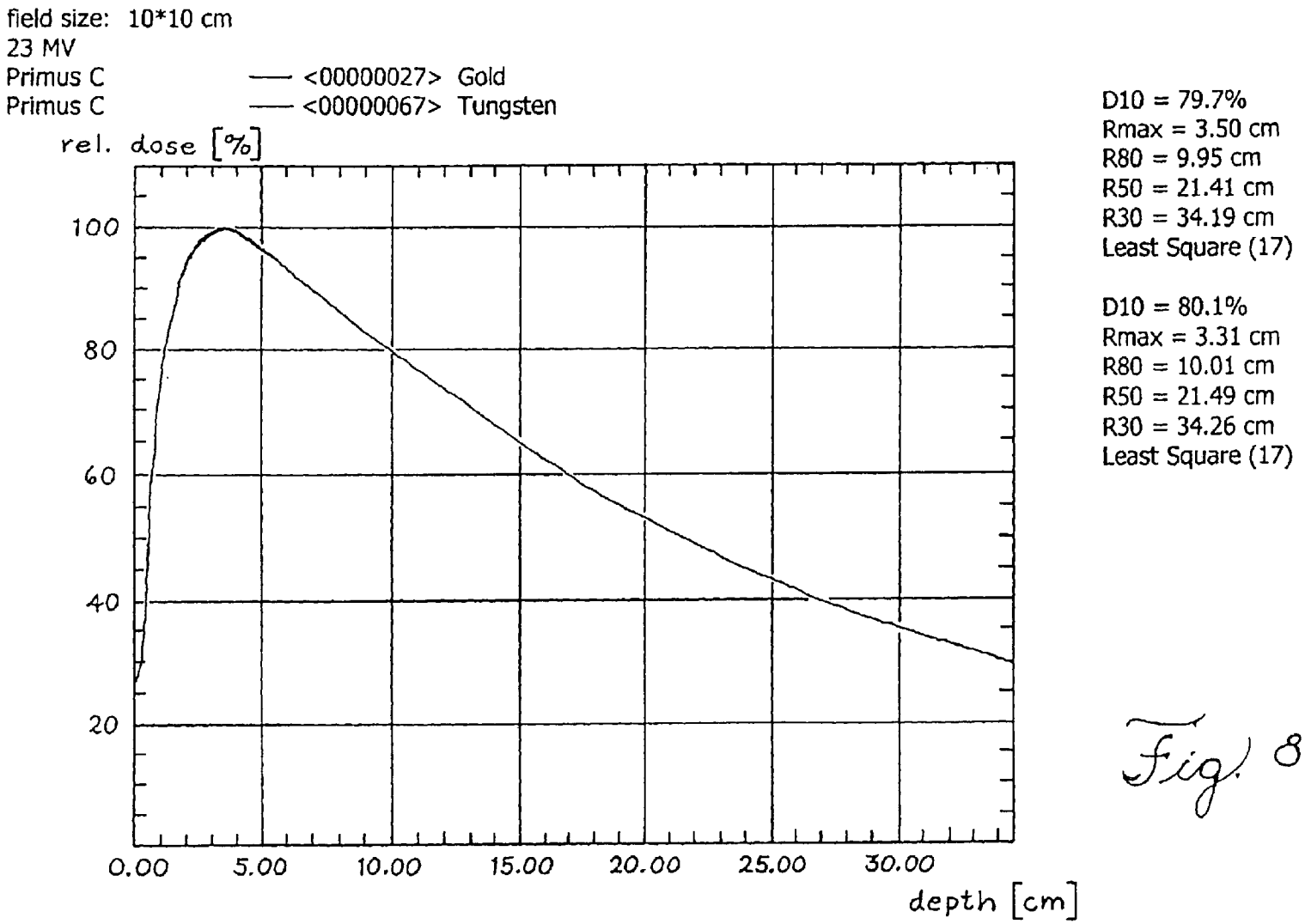
FIGS. 8–9 show various dose distribution charts for 23MV photons generated by the x-ray target assemblies of FIGS. 1–5.
Figure 9:
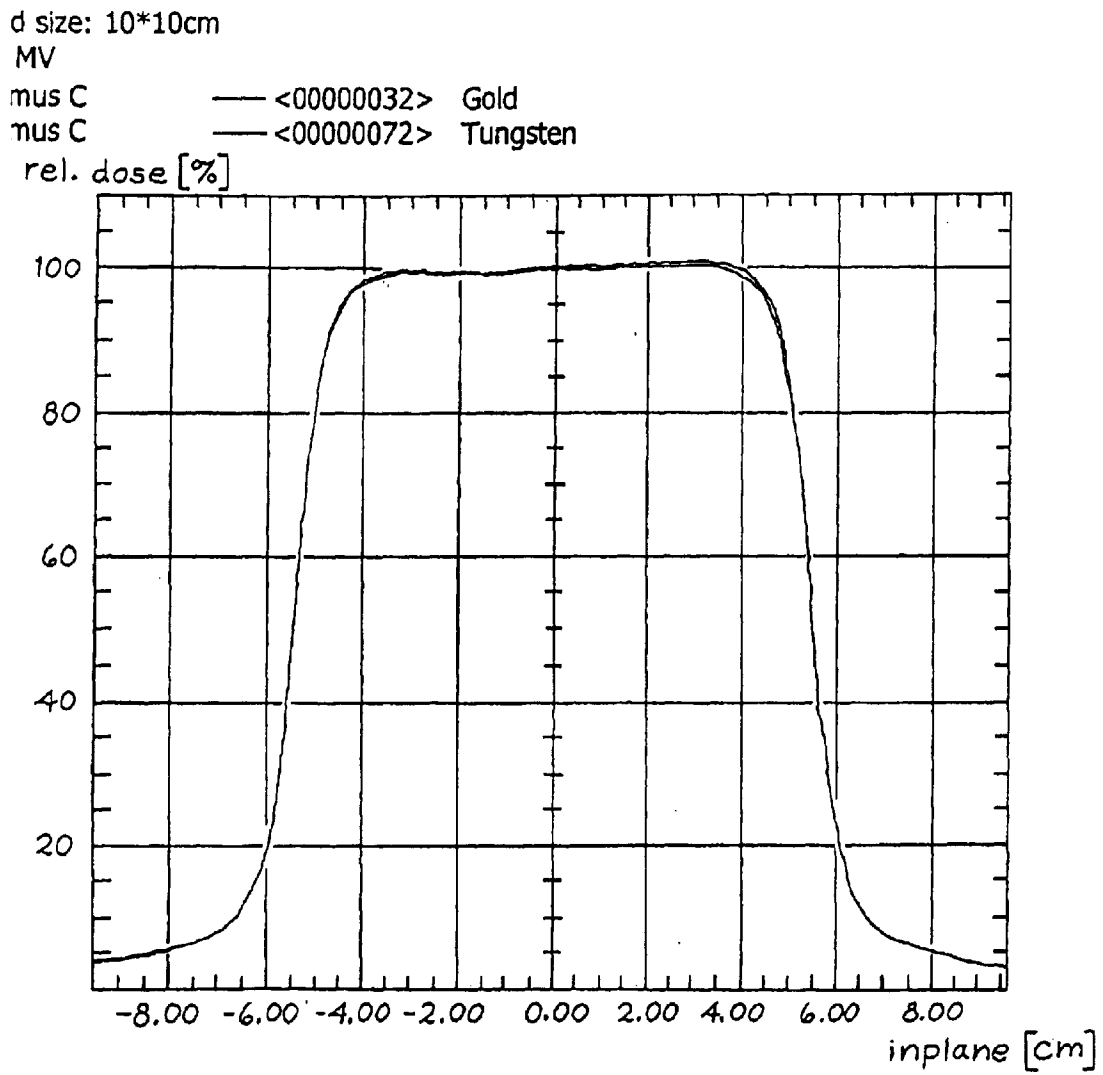

In practice, the x-ray target assembly 200 according to the present invention compares favorably with the known x-ray target assembly 100 discussed previously with respect to FIGS. 1–2. In particular, FIGS. 6–7 show the relative dose distributions for both x-ray target assemblies when struck by 6 MeV electrons. FIGS. 8–9 show the relative dose distributions for both x-ray target assemblies when struck by 23 MeV electrons. As can be seen the tungsten x-ray target assembly 200 produces results that substantially correspond to those of the gold x-ray target assembly 100. Thus, the present invention from a bremsstrahlung perspective produces a nearly identical dose distribution as the gold x-ray target assembly without changing any other primary beam line component from the original gold x-ray target assembly.

Within the scope of the present invention, further embodiment variations of course also exist besides the explained example.

We claim:

1. An x-ray target assembly, comprising:

a housing having a recess to contain a cooling fluid; and an x-ray target attached to said housing, the x-ray target having a first side to receive electrons having energies of greater than one MeV and a second side to emit x-rays for use in radiation therapy, wherein said x-ray target does not directly contact said recess and said cooling fluid is to be sealed within said recess via a joint not susceptible to galvanic corrosion.

2. An x-ray target assembly, comprising:

a housing having a recess to contain a cooling fluid; and an x-ray target attached to said housing, the x-ray target having a first side to receive electrons having energies of greater than one MeV and a second side to emit x-rays for use in radiation therapy, wherein said x-ray target does not directly contact said recess and said cooling fluid is to be sealed within said recess via a joint not susceptible to galvanic corrosion, and said joint is formed via electron beam welding.

3. An x-ray generator comprising:

a particle source to accelerate particles to energies greater than one MeV; and an x-ray target assembly comprising:

a housing having a recess to contain a cooling fluid; and an x-ray target attached to said housing, wherein said x-ray target does not directly contact said recess and said accelerated particles are to strike a first side of said x-ray target so that x-rays are emitted from a second side of said x-ray target, wherein said cooling fluid is sealed within said recess via a joint not susceptible to galvanic corrosion.

4. An x-ray generator comprising:

a particle source to accelerate particles to energies greater than one MeV; and an x-ray target assembly comprising:

a housing having a recess to contain a cooling fluid; and an x-ray target attached to said housing, wherein said x-ray target does not directly contact said recess and said accelerated particles are to strike a first side of said x-ray target so that x-rays are emitted from a second side of said x-ray target.

wherein said cooling fluid is sealed within said recess via a joint not susceptible to galvanic corrosion and said joint is formed via electron beam welding.

5. An x-ray target assembly, comprising:

a housing having a recess to contain cooling fluid; and an x-ray target attached to said housing;

wherein said recess is sealed via a joint not susceptible to galvanic corrosion.

6. The x-ray target assembly of claim 5, wherein said joint is formed via electron beam welding.

7. The x-ray target assembly of claim 5, wherein said housing further comprises a heat sink that lies over said recess and is to contact said cooling fluid.

8. The x-ray target assembly of claim 7, wherein said heat sink comprises a second recess that lies above said recess and is to contact said cooling fluid.

9. The x-ray target assembly of claim 7, wherein said x-ray target is attached to said heat sink.

10. The x-ray target assembly of claim 9, wherein said x-ray target is attached to said heat sink via a brazing material.

11. The x-ray target assembly of claim 7, wherein said heat sink is made of copper and said x-ray target is made of tungsten.

12. The x-ray target assembly of claim 11, wherein said housing is made of steel.

13. The x-ray target assembly of claim 5, wherein said x-ray target is made of tungsten.

14. The x-ray target assembly of claim 5, wherein said cooling fluid comprises water.

15. The x-ray target assembly of claim 5, further comprising a graphite electron absorber located adjacent to said recess.

16. An x-ray generator comprising:

a particle source to accelerate particles to energies greater than one MeV; and an x-ray target assembly comprising:

a housing having a recess to contain a cooling fluid; and an x-ray target attached to said housing said accelerated particles to strike said x-ray target so that x-rays are emitted from said x-ray target, wherein said recess is sealed via a joint not susceptible to galvanic corrosion.

17. The x-ray generator of claim 16, wherein said joint is formed via electron beam welding.

18. The x-ray generator of claim 16, wherein said x-ray target is made of tungsten.

19. The x-ray generator of claim 16, wherein said cooling fluid comprises water.

20. The x-ray generator of claim 16, wherein said particle source comprises a charged particle accelerator and wherein said particles are electrons.

* * * * *